US011076679B1

(12) United States Patent
Chung et al.

(10) Patent No.: US 11,076,679 B1
(45) Date of Patent: Aug. 3, 2021

(54) STICK TYPE COSMETIC CONTAINER

(71) Applicant: CTK COSMETICS CO., LTD., Seoul (KR)

(72) Inventors: In Yong Chung, Seoul (KR); Sun Young Choi, Seoul (KR); In Young Um, Seoul (KR); Kyung Ho Kang, Suwon-si (KR)

(73) Assignee: CTK COSMETICS CO., LTD., Seoul (KR)

( * ) Notice: Subject to any disclaimer, the term of this patent is extended or adjusted under 35 U.S.C. 154(b) by 0 days.

(21) Appl. No.: 16/836,156

(22) Filed: Mar. 31, 2020

(30) Foreign Application Priority Data

Jan. 20, 2020 (KR) ..... 10-2020-0007550
Feb. 28, 2020 (KR) ..... 10-2020-0025008

(51) Int. Cl.
*B43K 21/08* (2006.01)
*A45D 40/06* (2006.01)
*A45D 40/00* (2006.01)

(52) U.S. Cl.
CPC ..... *A45D 40/06* (2013.01); *A45D 40/065* (2013.01); *A45D 2040/0062* (2013.01)

(58) Field of Classification Search
CPC ..... A45D 34/06; A45D 34/065; A45D 40/06; A45D 40/065
USPC ..... 401/75, 78
See application file for complete search history.

(56) References Cited

U.S. PATENT DOCUMENTS 6,343,886 B2 * 2/2002 Shochat ..... A45D 40/06 401/87
8,172,472 B2 * 5/2012 Tani ..... A45D 40/04 401/78
8,915,664 B2 * 12/2014 Lu ..... A45D 40/06 401/78
9,795,207 B2 * 10/2017 Denece ..... A45D 40/205

FOREIGN PATENT DOCUMENTS

KR 20-0484721 Y1 10/2017
KR 10-1915739 B1 11/2018

* cited by examiner

*Primary Examiner* — Jennifer C Chiang
(74) *Attorney, Agent, or Firm* — Novick, Kim & Lee, PLLC; Jae Youn Kim; Jihun Kim

(57) ABSTRACT

A stick type cosmetic container includes: a handle for controlling ascent and descent of the cosmetic substance; an inner container joined between an outer end part and an inner end part of the handle and having a first hollow part disposed therein; an inner member joined between the inner container and the inner end part of the handle to be fixed in location; a holder capable of being lifted up and down inside the inner container along a screw thread part disposed on the inner end part of the handle; and an outer container for covering the inner container, wherein the holder includes a first inner holder and a second inner holder, and a second hollow part disposed inside the first inner holder and the second inner holder to accommodate the residual quantity of the cosmetic substance in the second hollow part.

7 Claims, 11 Drawing Sheets

STICK TYPE COSMETIC CONTAINER

BACKGROUND OF THE INVENTION

Field of the Invention

The present invention relates to a stick type cosmetic container capable of exhausting the remaining amount of a cosmetic, and more particularly, to a stick type cosmetic container, which can exhaust the remaining amount of a cosmetic, such as a lipstick, a lip gloss, a sunblock stick, and others, without waste, and can be separated and discharged after being used completely.

Background Art

Recently, interest in the cosmetics industry is running high, and it relates to the aspects that distribution networks, such as online channels, are diversified and sales performance of domestic cosmetic brands has been increased greatly in China, Asian nations, and other countries due to the Korean wave. Such emergence of the domestic cosmetics industry is called K-beauty, and is in the limelight as one of main market flows.

In connection with cosmetic technology, cosmetic containers and cosmetic manufacturing methods with improved functionality and usability together with cosmetic composition or formula including natural ingredients or functional ingredients have been developed continuously.

The cosmetic containers are containers to store a cosmetic substance or makeup tools, such as puffs, therein, and forms and structures of the cosmetic containers are as varied as kinds of cosmetics.

For example, there is a stick type cosmetic container. The stick type cosmetic container generally includes an inner container, which stores a cosmetic substance of a solid state or a semisolid state, such as lipsticks, lip glosses, sunblock sticks, and others, and an outer container for protecting the inner container storing the cosmetic substance therein.

However, in such a stick type cosmetic container, a lot of the cosmetic substance is not used and is wasted. Moreover, the conventional stick type cosmetic container has inconvenience in that a user must dig out the remainder with a cotton swab or freeze the remainder when removing the cosmetic contents.

Referring to FIG. 1, a cosmetic substance 1000 is put in a cosmetic holder 2000. Here, the contents located in an inner part of the cosmetic holder 2000 is called a residual quantity 1001, and the residual quantity cannot be used finally.

In order to solve such a problem, several techniques have been proposed (see the following patent document 1 and patent document 2), but there is still a structural difficulty in using the entire amount of the cosmetic substance. Additionally, a stick type cosmetic container which is simple and convenient in structure to enhance productivity and usability is not yet developed.

PATENT LITERATURE

Patent Documents

Patent Document 1: Korean Patent No. 10-1915739 (published on Nov. 6, 2018)

Patent Document 2: Korean Utility Model Registration No. 20-0484721 (published on Oct. 18, 2017)

SUMMARY OF THE INVENTION

Accordingly, the present invention has been made to solve the above-mentioned problems occurring in the prior arts, and it is an object of the present invention to provide a stick type cosmetic container, which can exhaust the remaining amount of cosmetics, such as lipsticks, lip glosses, sunblock sticks, and others, without waste, and can be separated and discharged after being used completely.

The effects of the present invention are not limited to the above-mentioned effects, and other technical effects which are not described above will be clearly understood by a person skilled in the art from the description below.

To accomplish the above object, according to the present invention, there is provided a stick type cosmetic container capable of exhausting the residual quantity of a cosmetic substance, including: a handle for controlling ascent and descent of the cosmetic substance; an inner container joined between an outer end part and an inner end part of the handle and having a first hollow part disposed therein; an inner member joined between the inner container and the inner end part of the handle to be fixed in location; a holder capable of being lifted up and down inside the inner container along a screw thread part disposed on the inner end part of the handle; and an outer container for covering the inner container, wherein the holder includes a first inner holder and a second inner holder, and a second hollow part disposed inside the first inner holder and the second inner holder to accommodate the residual quantity of the cosmetic substance in the second hollow part, and when the cosmetic substance in the first hollow part is exhausted, the first inner holder is lifted up inside the second inner holder in order to expose the residual quantity of the cosmetic substance in the second hollow part to the outside.

In an embodiment of the present invention, a second inner holder upper end part disposed at the upper side of the second inner holder is an inclined part or an undercut.

In an embodiment of the present invention, the first inner holder has a first inner holder outer face protrusion disposed on the outer face of an upper end thereof, the second inner holder has a second inner holder inner face concave part disposed on the inner face of a lower end thereof, and the first inner holder outer face protrusion part and the second inner holder inner face concave part are combined with each other.

In an embodiment of the present invention, a first inner holder intermediate protrusion part is disposed at the central part of the first inner holder, an inner member upper face part is disposed at an upper end of the inner member, and the inner member upper face part is a stopper getting in contact with the first inner holder intermediate protrusion part, and a first inner holder lower face protrusion part 413 disposed at the outer face of the lower end thereof in the outer circumferential direction.

In an embodiment of the present invention, when the first inner holder intermediate protrusion part passes through the inner member upper face part by an external force, the combination between the first inner holder outer face protrusion part and the second inner holder inner face concave part is released, so that the first inner holder ascends relative to the second inner holder.

In an embodiment of the present invention, the inner container upper part at the upper end of the inner container is the inner container upper face protrusion part, and the inner container upper face protrusion part is a stopper getting in contact with the second inner holder upper end part of the second inner holder.

In an embodiment of the present invention, an inner holder upper face concave part is disposed at the upper face of the first inner holder.

The stick type cosmetic container according to the present invention can exhaust the remaining amount of cosmetics, such as lipsticks, lip glosses, sunblock sticks, and others, without waste, and can be separated and discharged after being used completely.

Moreover, the stick type cosmetic container according to the present invention has a simple and convenient structure to enhance productivity and usability.

The effects of the present invention are not limited to the above-mentioned effects, and it will be understood that the detailed description of the present invention or claims include all effects derivable from the configuration of the present invention.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
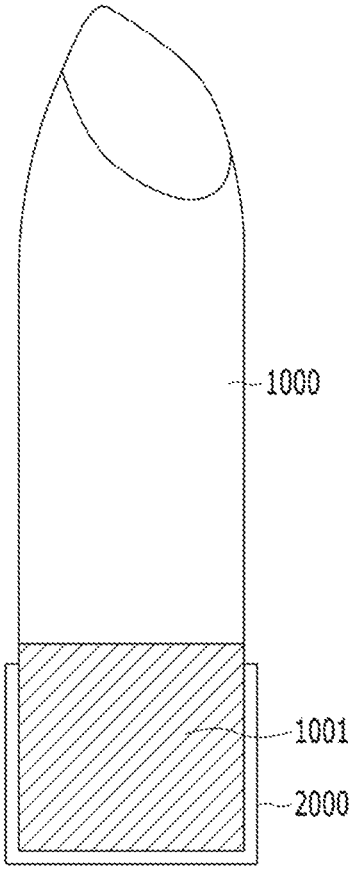
FIG. 1 is a schematic diagram showing a state where the residual quantity of a cosmetic substance in a conventional stick type cosmetic container is abandoned.

Hereinafter, the present invention will be described in detail with reference to the accompanying drawings. However, embodiments of the present invention may be implemented in several different forms and are not limited to the embodiments described herein. In addition, parts irrelevant to description are omitted in the drawings in order to clearly explain embodiments of the present invention. Similar parts are denoted by similar reference numerals throughout this specification.

Throughout this specification, when a part is referred to as being "connected" to another part, this includes "direct connection" and "indirect connection" via an intervening part. Also, when a certain part "includes" a certain component, other components are not excluded unless explicitly described otherwise, and other components may in fact be included.

The terms used in the following description are intended to merely describe specific embodiments, but not intended to limit the invention. An expression of the singular number includes an expression of the plural number, so long as it is clearly read differently. The terms such as "include" and "have" are intended to indicate that features, numbers, steps, operations, elements, components, or combinations thereof used in the following description exist and it should thus be understood that the possibility of existence or addition of one or more other different features, numbers, steps, operations, elements, components, or combinations thereof is not excluded.

Hereinafter, embodiments of the invention will be described in detail with reference to the accompanying drawings.

Figure 2:
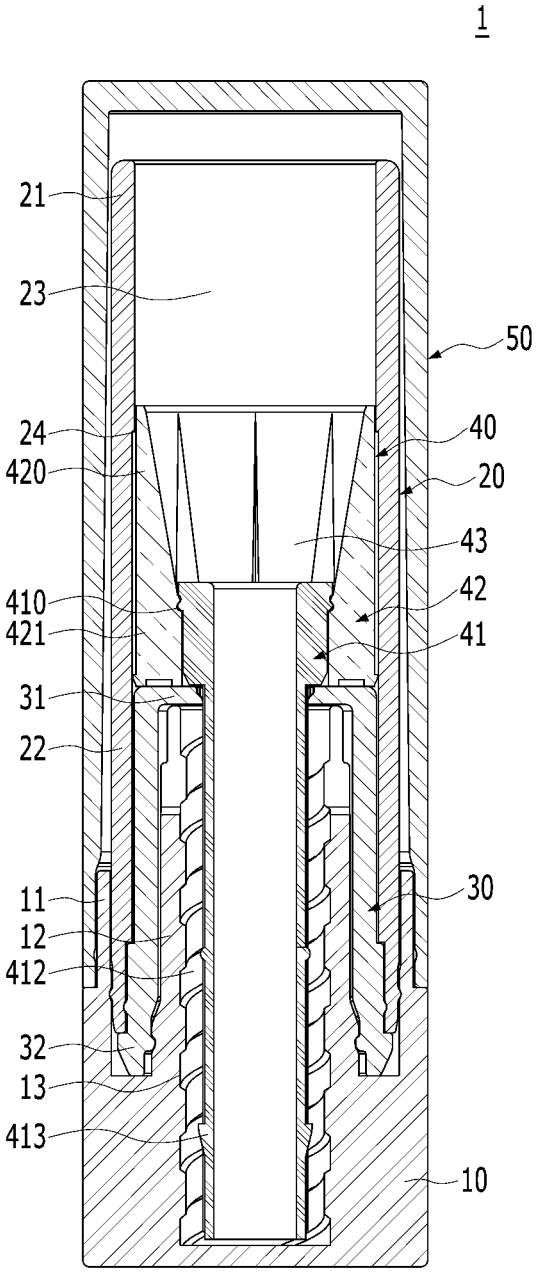
FIG. 2 is a sectional view showing an initial operational state (non-use state) of a stick type cosmetic container according to a first preferred embodiment of the present invention.
Figure 3A:
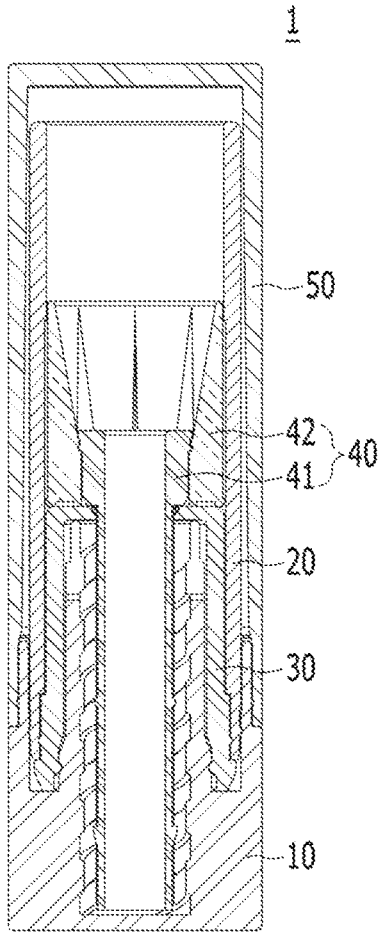
FIGS. 3(*a*), 3(*b*) and 3(*c*) are schematic diagrams showing an operational process of the stick type cosmetic container of FIG. 2.
Figure 3B:
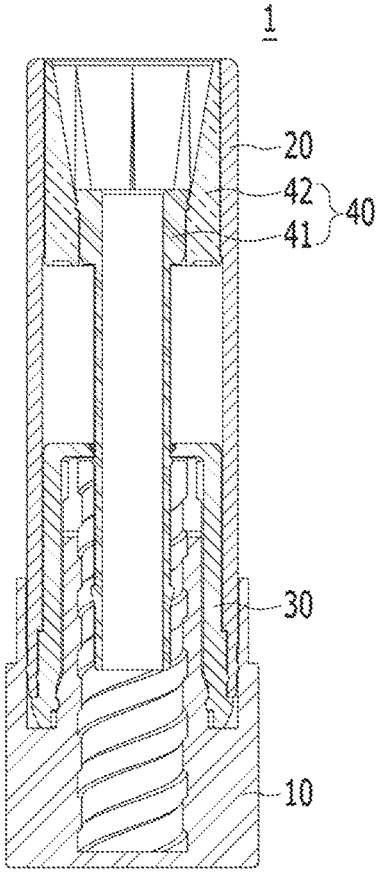
Figure 3C:
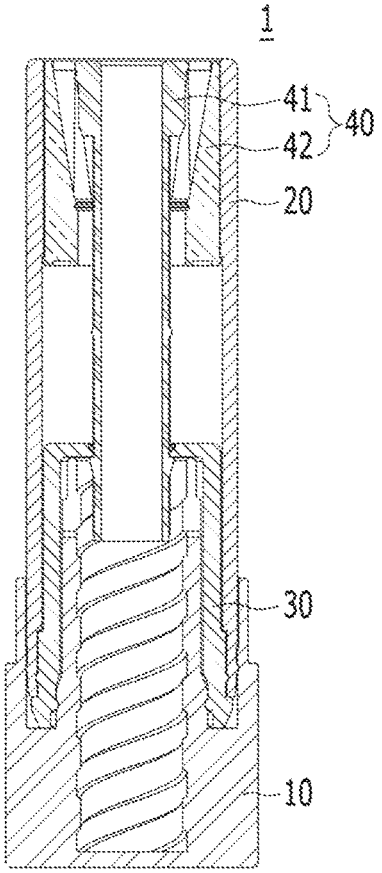

FIG. 2 is a sectional view showing an initial operational state (non-use state) of a stick type cosmetic container according to a first preferred embodiment of the present invention, and FIG. 3 is a schematic diagram showing an operational process of the stick type cosmetic container of FIG. 2.

Figure 4:
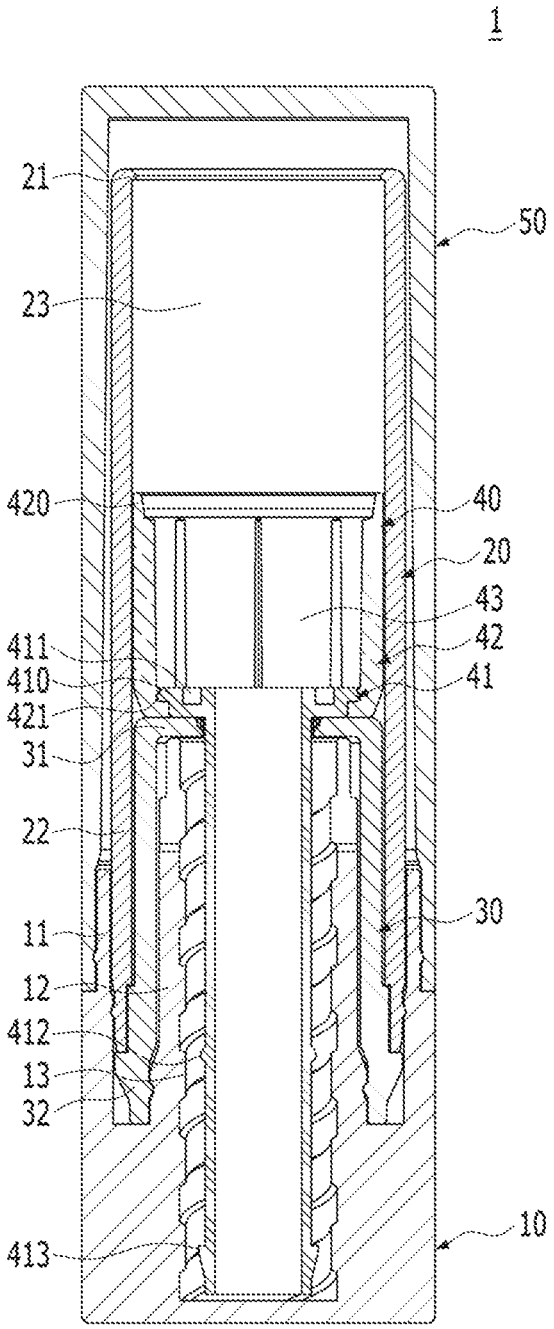
FIG. 4 is a sectional view showing an initial operational state of a stick type cosmetic container according to a second preferred embodiment of the present invention.
Figure 5A:
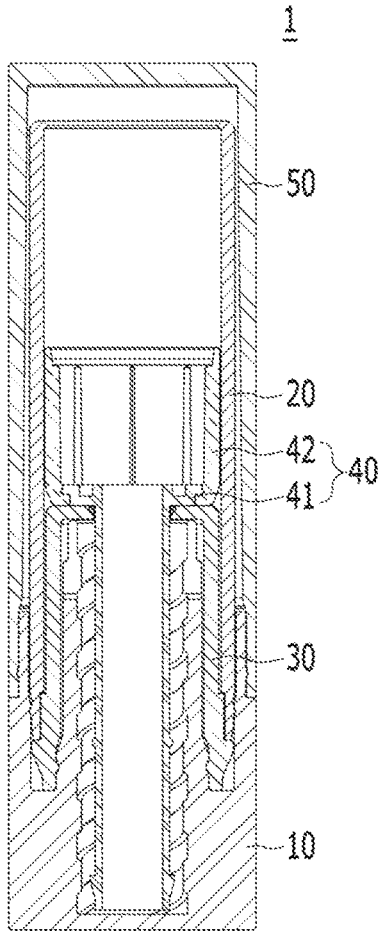
FIGS. 5(*a*), 5(*b*) and 5(*c*) are schematic diagrams showing an operational process of the stick type cosmetic container of FIG. 4.
Figure 5B:
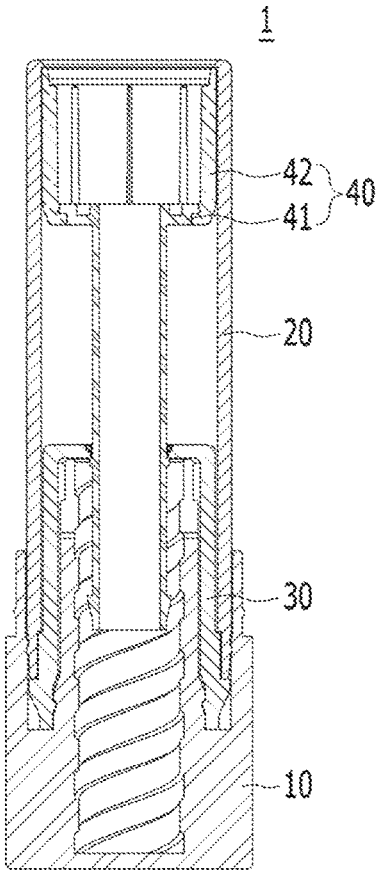
Figure 5C:
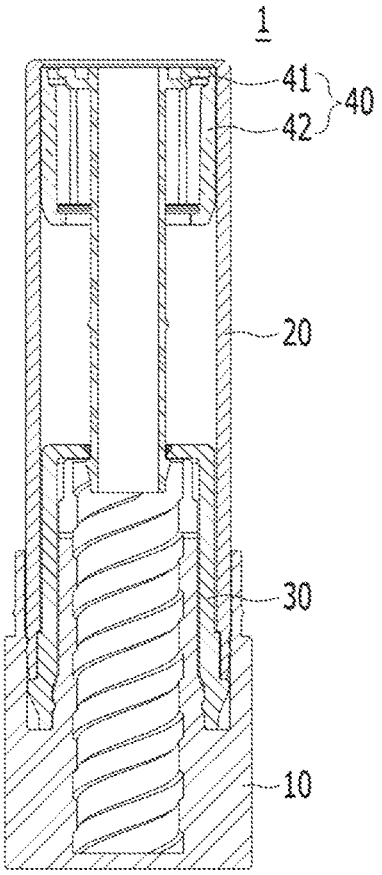
Figure 6:
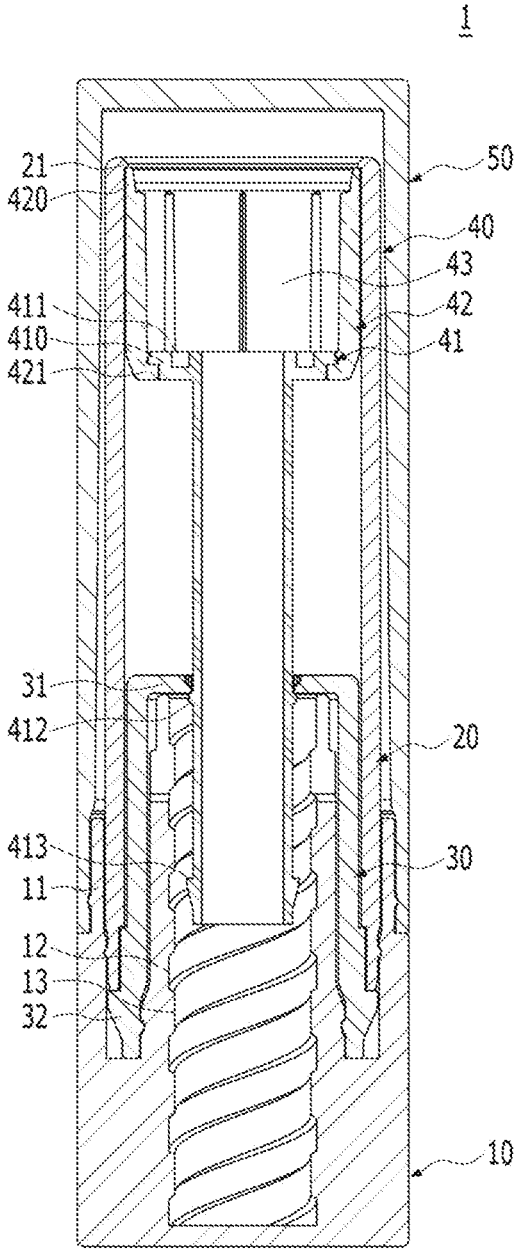
FIG. 6 is a sectional view showing a normal operational state (use state) of the stick type cosmetic container.
Figure 7:
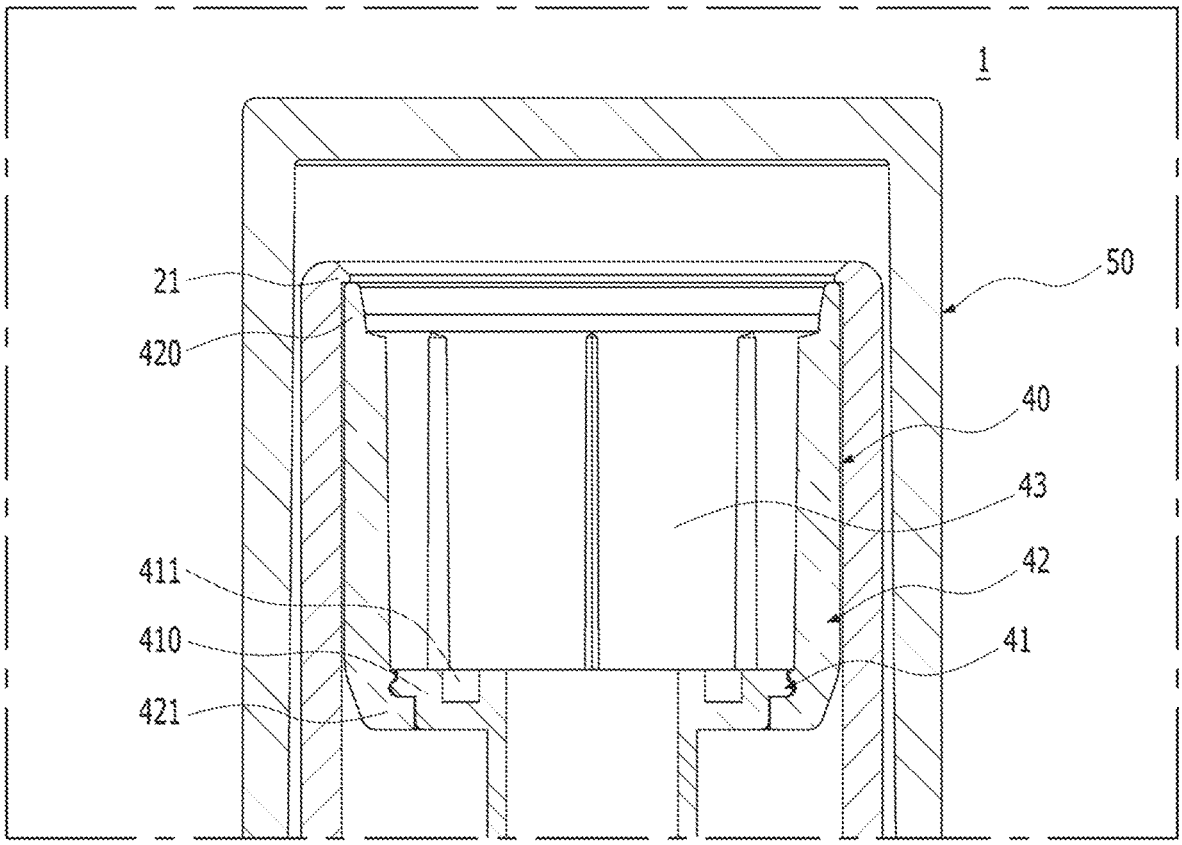
FIG. 7 is a sectional view of the stick type cosmetic container of FIG. 6.
Figure 8:
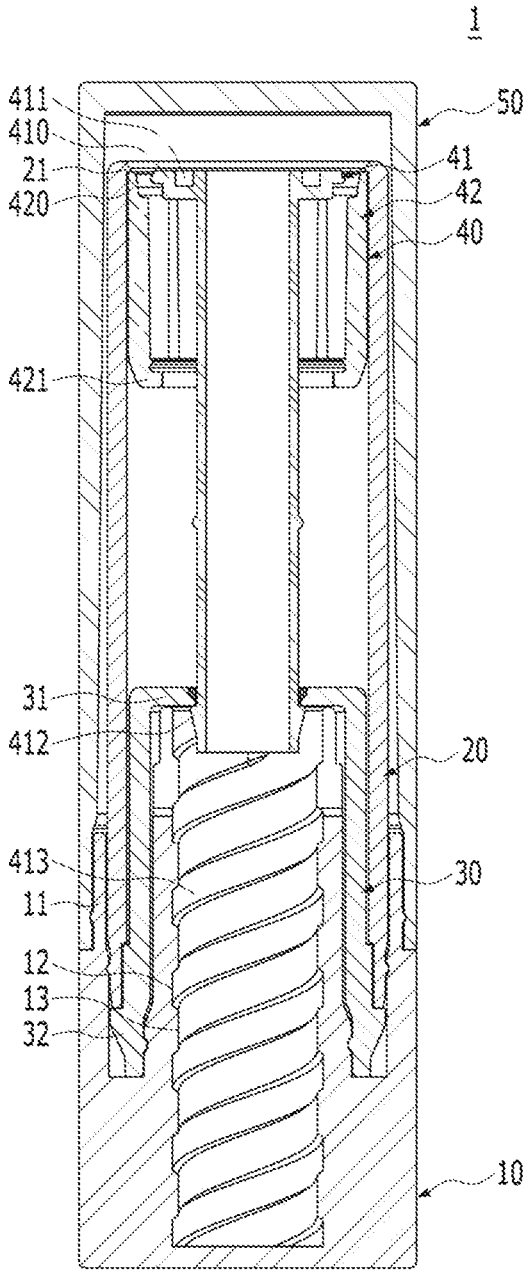
FIG. 8 is a sectional view showing the last use state (residual quantity use state) of the stick type cosmetic container of FIG. 4.
Figure 9:
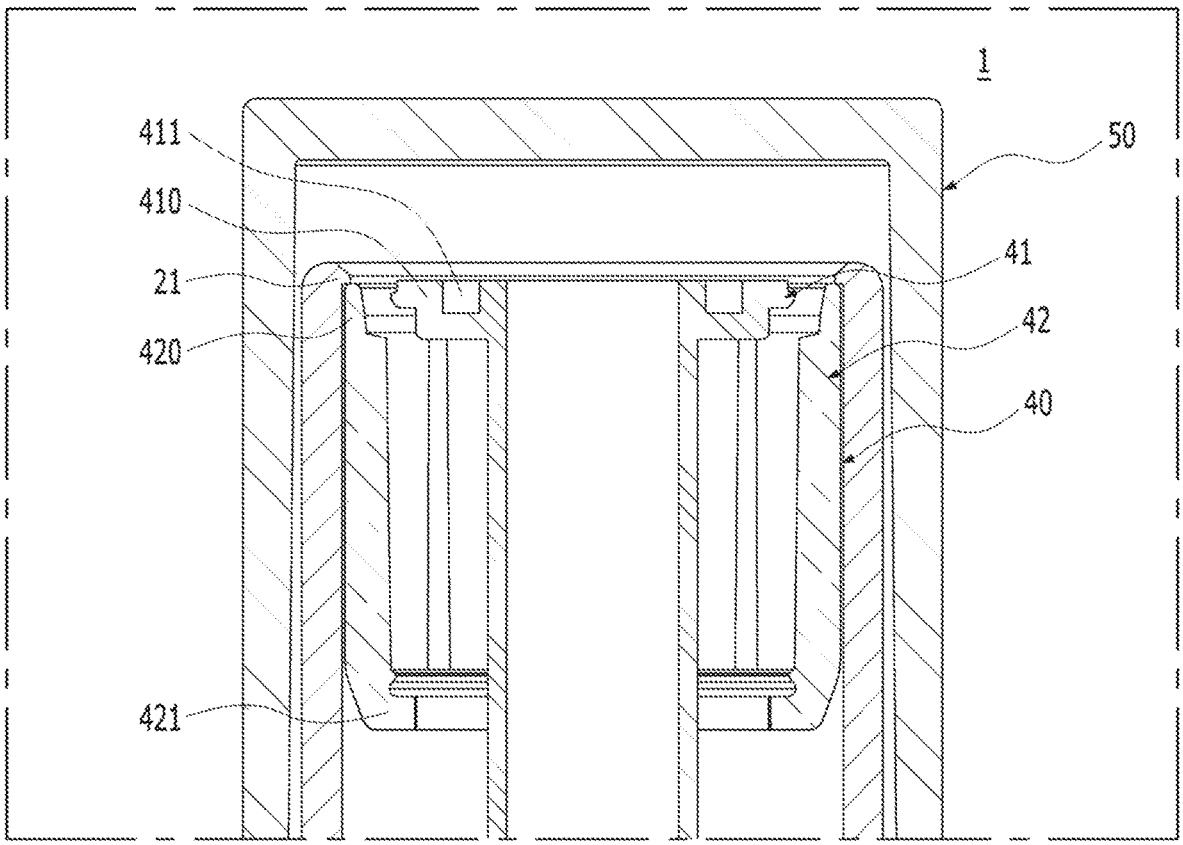
FIG. 9 is a sectional view of the stick type cosmetic container of FIG. 8.

Moreover, FIG. 4 is a sectional view showing an initial operational state of a stick type cosmetic container according to a second preferred embodiment of the present invention, FIG. 5 is a schematic diagram showing an operational process of the stick type cosmetic container of FIG. 4, FIG. 6 is a sectional view showing a normal operational state (use state) of the stick type cosmetic container, FIG. 7 is a sectional view of the stick type cosmetic container of FIG. 6, FIG. 8 is a sectional view showing the last use state (residual quantity use state) of the stick type cosmetic container of FIG. 4, and FIG. 9 is a sectional view of the stick type cosmetic container of FIG. 8.

Here, FIG. 5(*a*) corresponds to FIG. 4, FIG. 5(*b*) corresponds to FIGS. 6 and 7, and FIG. 5(*c*) corresponds to FIGS. 8 and 9. Furthermore, FIGS. 3(*a*), 3(*b*) and 3(*c*) respectively show the same operational processes as FIGS. 5(*a*), 5(*b*) and 5(*c*).

In the meantime, the stick type cosmetic container 1 according to the first preferred embodiment of the present invention (see FIG. 2) and the stick type cosmetic container 1 according to the second preferred embodiment of the present invention (see FIG. 4) are identical or similar to each other in function or configuration except the shape of an inner container upper part 21, the shape of the upper surface of a first inner container 41, and the shape of an upper part of a second inner container 42. Therefore, hereinafter, without discrimination of the embodiments, the configuration and the operational process of the stick type cosmetic container 1 according to the present invention will be described, and different parts in the embodiments will be described separately.

As shown in the drawings, the stick type cosmetic container 1 according to the embodiment of the present invention is a container capable of exhausting the residual quantity of a cosmetic substance.

The stick type cosmetic container 1 includes: a handle 10 for controlling ascent and descent of the cosmetic substance; an inner container 20 joined between an outer end part 11 and an inner end part 12 of the handle 10 and having a first hollow part 23 formed therein; an inner member 30 joined between the inner container 20 and the inner end part 12 of the handle 10 to be fixed in its location; a holder 40 elevatable from the inside of the inner container 20 along a screw thread part 13 formed on the inner end part 12 of the handle; and an outer container 50 for covering the inner container 20.

Here, the holder 40 includes a first inner holder 41 and the second inner holder 42; and a second hollow part 43 disposed in the first inner holder 41 and the second inner holder 42 to accommodate the residual quantity of the cosmetic substance therein.

When the cosmetic substance in the first hollow part 23 is exhausted, the first inner holder 41 ascends from the second inner holder 42 so that the residual quantity of the cosmetic substance in the second hollow part 43 is exposed to the outside.

In more detail, the handle 10 includes the outer end part 11 and the inner end part 12. The inner end part 12 of the handle has the screw thread part 13 in order to lift up and down the holder 40 out of and into the inner container 20 depending on rotation of the handle 10, which will be described later.

The inner container 20 is a cylindrical member, and a lower end part 22 of the inner container 20 may be inserted between the outer end part 11 and the inner end part 12 of the handle 10 to be joined in a relatively rotatable manner. The inner container 20 further includes the upper part 21 disposed at the upper side thereof.

The inner container 20 has the first hollow part 23 disposed therein, and the first hollow part 23 is a space fixed at the holder 40 to store the cosmetic substance of a solid state or a semisolid state therein, and serves as a space for lifting up and down the holder 40.

The inner container 20 has a stepped jaw 24 disposed at the central portion of the inner face thereof. An upper end of a second inner holder 42 is located at an upper portion of the inner container where the stepped jaw 24 is formed, and the location of the upper end of the second inner holder 42 may be varied according to stroke. In the meantime, a protrusion part may be formed at an outer face of a lower end of the second inner holder 42 in a radial direction. If the upper end of the second inner holder 42 is at the maximum stroke, namely, in case of the normal operational state (use state) of FIG. 3(*b*) and in case of the final use state (residual quantity use state) of FIG. 3(*c*), the protrusion part of the lower end of the second inner holder 42 may be combined with the stepped jaw 24 of the inner container 20.

The inner member 30 is a cylindrical member, and may be joined between the inner container 20 and the inner end part 12 of the handle to be fixed. An inner member upper surface part 31 is disposed at the upper side of the inner member 30 in a flange form, and an inner member lower side protrusion part 32 is disposed at the lower side of the inner member 30 to protrude outwardly in an outer circumferential direction.

The holder 40 may include a first inner holder 41 and the second inner holder 42.

The first inner holder 41 and the second inner holder 42 may be operated like a single member in the normal use state, namely, in the non-use state which is the initial operational state (locked state) and in the normal use state (use state).

After that, if the cosmetic substance is exhausted, namely, if the cosmetic substance in the first hollow part 23 is exhausted, when the first inner holder 41 is lifted upwards from the second inner holder 42 by external force, the residual quantity of the cosmetic substance existing in the second hollow part 43 disposed inside the first inner holder 41 and the second inner holder 42 is exposed to the outside.

The first inner holder 41 includes a first inner holder outer face protrusion part 410 disposed at the outer face of the upper end thereof, a first inner holder intermediate protrusion part 412 disposed at the central part thereof, and a first inner holder lower face protrusion part 413 disposed at the outer face of the lower end thereof in the outer circumferential direction.

The second inner holder 41 includes a second inner holder upper end part 420 disposed at the upper side thereof, and the second inner holder upper end part 420 may be an inclined part or an undercut. The second inner holder upper end part 420 comes into contact with the inner container upper part 21 when the holder 40 is lifted up.

The second inner holder 42 includes a second inner holder inner face concave part 421 formed inwardly from the lower part of the second inner holder 42.

Therefore, the first inner holder outer face protrusion part 410 and the second inner holder inner face concave part 421 may be combined with each other. Differently from the above embodiment, the first inner holder 41 may have a concave part and the second inner holder 42 may have a protrusion part such that the concave part and the protrusion part are combined with each other.

As described above, the first inner holder intermediate protrusion part 412 is disposed at the central part of the first inner holder 41, and the inner member upper face part 31 is disposed at the upper side of the inner member 30. The inner member upper face part 31 may be a stopper getting in contact with the first inner holder intermediate protrusion part 412 (see FIGS. 6 and 7).

When the first inner holder intermediate protrusion part 412 passes through the inner member upper face part 31 by the external force, the combination between the first inner holder outer face protrusion part 410 and the second inner holder inner face concave part 421 is released, so that the first inner holder 41 can ascend relative to the second inner holder 42 (see FIGS. 8 and 9). Therefore, the cosmetic substance existing in the second hollow part 43 is exposed to the outside.

In the meantime, even though the first inner holder 41 ascends relative to the second inner holder 42, the first inner holder lower face protrusion part 413 is caught to the inner member upper face part 31 which serves as a stopper so as to prevent the first inner holder 41 from ascending relative to the second inner holder excessively.

Moreover, the second inner holder 41 has a rib disposed therein, so that the first inner holder 41 can move relative to the second inner holder 41 by a guide of the rib. For this, the first inner holder 42 has a cut part. Therefore, the holder can ascend and descend by such a rail guide manner.

Now, a use process of the stick type cosmetic container 1 according to the present invention will be described as follows. First, in the initial operational state (non-use state), the outer container 50 covers the outside of the handle 10, and the holder 40 is located at the lower end (See FIGS. 3(*a*) and 5(*a*). In this state, the first inner holder 41 and the second inner holder 42 may get in contact with the inner member upper face part 31.

After that, in the normal operational state (use state), the user first removes the outer container 50, and then, manipulates the handle 10 to lift up the holder 40, so that the cosmetic substance, such as a lipstick, accommodated in the holder 40 is exposed to the outside from the inner container 20. Then, the user can apply make-up using the exposed cosmetic substance (see FIGS. 3(*b*) and 5(*b*)). When the user finishes make-up, the user manipulates the handle 10 to lift down the holder 40, and after that, combines the outer container 50 with the outer face of the handle 10. So, the stick type cosmetic container returns to the initial operational state (non-use state).

If most of the cosmetic substance has been used and the user cannot use the cosmetic substance in the normal operational state, or if the user wants to disassemble or separate the components in order to abandon the cosmetic container, it is called the final use state (residual quantity use state). In the final use state, the user manipulates the handle 10 to lift up the holder 40 to the maximum, and when additional external force is applied, the first inner holder 41 and the second inner holder 42 which have been operated integrally are separated from each other. Therefore, when the first inner holder 41 is ascended from the second inner holder 42, the residual quantity of the cosmetic substance existing in the second hollow part 43 is exposed to the outside. Therefore, the user can use the residual quantity of the cosmetic substance (see FIGS. 3(*c*) and 5(*c*)).

FIGS. 8 and 9 illustrate the state where the first inner holder 41 is ascended from the second inner holder 42 to the maximum.

In the meantime, in the second preferred embodiment of the present invention (see FIG. 4), the inner container upper part 21 is disposed at the upper side of the inner container 20, and the inner container upper part 21 has the inner member upper face part. The inner member upper face part protrudes toward the inner face of the container, that is, toward the first hollow part 23. The inner container upper part 21 may be a stopper getting in contact with the second inner holder upper end part 420.

That is, when the holder 40 is lifted up, the second inner holder upper end part 420 gets in contact with the inner container upper part 21 of the protruding shape, and due to the stopper structure, the second inner holder 42 can be prevented from being removed or protruding outwardly from the inner container 20.

Moreover, in the second preferred embodiment of the present invention, an inner holder upper face concave part 411 may be disposed at the upper face of the first inner holder 42. The inner holder upper face concave part 411 serves to fix the cosmetic substance, and instead of the inner holder upper face concave part 411 or in addition to the inner holder upper face concave part 411, a protrusion type member may be disposed.

Figure 10A:
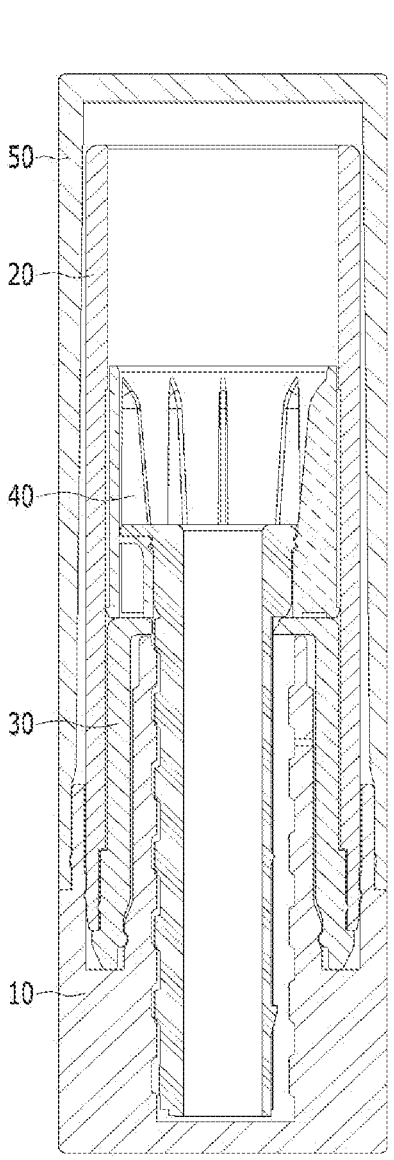
FIGS. 10(*a*) and 10(*b*) are views showing a stick type cosmetic container of a filling type according to a third preferred embodiment of the present invention.
Figure 10B:
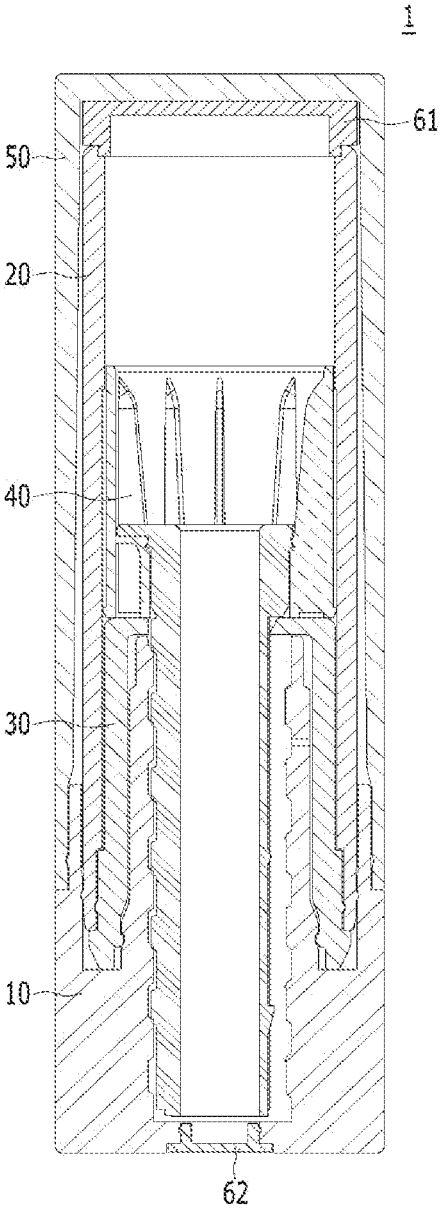

In the above description, the configuration and effects of the stick type cosmetic container 1 are described in an aspect of use. Hereinafter, referring to the drawings, in connection with manufacturing of the stick type cosmetic container 1, especially, in relation with a filling method of the cosmetic substance, will be described. FIG. 10 is a view showing a stick type cosmetic container of a filling type according to a third preferred embodiment of the present invention.

As shown in the drawing, in order to fill the cosmetic container 1 with the cosmetic substance, there are an upper end filling method for filling the holder 40 with the cosmetic substance from the upper end of the cosmetic container 1 (see FIG. 10(*a*)) and a lower end filling method for filling the holder 40 with the cosmetic substance from the lower end of the cosmetic container 1 (see FIG. 10(*b*)).

The structures described in the first and second preferred embodiments can be all applied to the upper end filling and the lower end filling. Furthermore, the structure of the cosmetic container may be changed or components may be added according to the upper end filling and the lower end filling. For instance, as shown in FIG. 10(*b*), for the lower end filling of the cosmetic substance, an inner cover 61 may be disposed at the upper end of the inner face of the outer container 50 of the cosmetic container 1, and a filling holder member 62 may be disposed at the central part of the lower end of the handle 10.

Figure 11A:
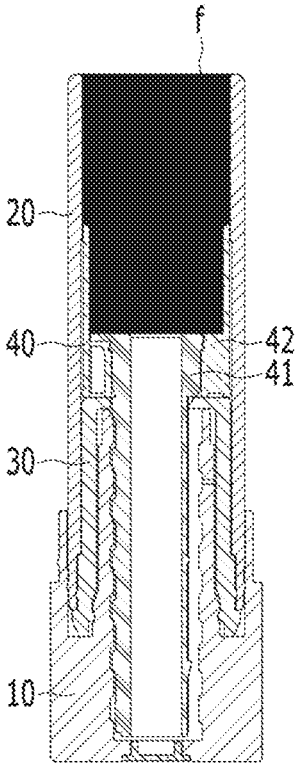
FIGS. 11(*a*), 11(*b*) and 11(*c*) are schematic diagrams showing an operational process of the stick type cosmetic container containing a cosmetic substance.
Figure 11B:
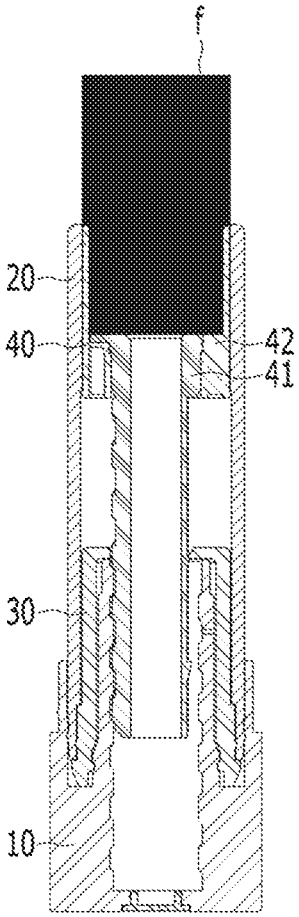
Figure 11C:
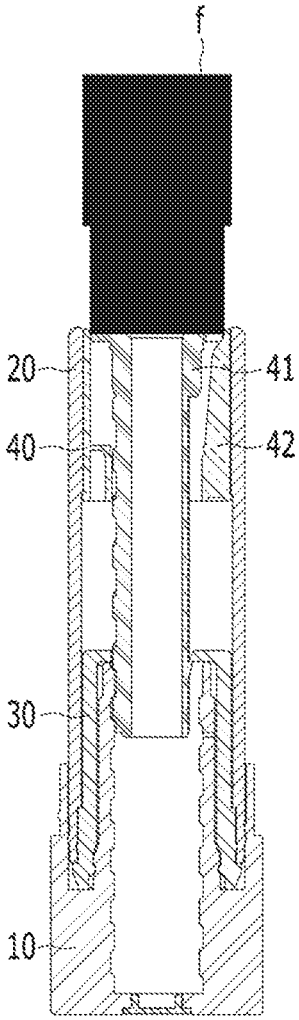

Next, FIG. 11 is a schematic diagram showing an operational process of the stick type cosmetic container containing a cosmetic substance. FIG. 11(*a*) illustrates the initial operational state (non-use state), 11(*b*) illustrates the normal operational state (use state), and 11(*c*) illustrates the final use state (residual quantity use state). As shown in the drawings, a cosmetic substance (f) is accommodated in the second inner container 42, and if the quantity of the cosmetic substance (f) is enough, the first inner container 41 and the second inner container 42 may be lifted up and down integrally. If most of the cosmetic substance is exhausted and the residual quantity exists just in the second inner container 42, the first inner container 41 is separated from the second inner container 42, and then is lifted up relative to the second inner container 42 so as to expose the residual quantity of the cosmetic substance (f) to the outside.

As described above, the stick type cosmetic container 1 according to the present invention can exhaust the remaining amount of cosmetics without waste, and can be separated and discharged after being used completely. Moreover, the stick type cosmetic container according to the present invention has a simple and convenient structure to enhance productivity and usability.

The above description is only exemplary, and it will be understood by those skilled in the art that the invention may be embodied in other concrete forms without changing the technological scope and essential features. Therefore, the above-described embodiments should be considered only as examples in all aspects and not for purposes of limitation. For example, each component described as a single type may be realized in a distributed manner, and similarly, components that are described as being distributed may be realized in a coupled manner.

The scope of the present invention is defined by the appended claims, and encompasses all modifications or alterations derived from meanings, the scope and equivalents of the appended claims.

What is claimed is:

1. A stick type cosmetic container capable of exhausting a residual quantity of a cosmetic substance, the stick type cosmetic container comprising:

a handle configured for controlling ascent and descent of the cosmetic substance;

an inner container joined between an outer end part and an inner end part of the handle and having a first hollow part disposed therein;

an inner member joined between the inner container and the inner end part of the handle;

a holder capable of being lifted up and down inside the inner container along a screw thread part formed on the inner end part of the handle; and an outer container configured for covering the inner container, wherein the holder includes a first inner holder, a second inner holder, and a second hollow part disposed inside the first inner holder and the second inner holder to accommodate the residual quantity of the cosmetic substance in the second hollow part, and wherein the first inner holder is configured to be lifted up inside the second inner holder, when the cosmetic substance in the first hollow part is exhausted, in order to expose the residual quantity of the cosmetic substance in the second hollow part to outside.

2. The stick type cosmetic container according to claim 1, wherein the second inner holder includes a second inner holder upper end part disposed at an upper side of the second inner holder, and the second inner holder upper end part is an inclined part or an undercut.

3. The stick type cosmetic container according to claim 1, wherein the first inner holder has a first inner holder outer face protrusion disposed on an outer face of an upper end thereof, the second inner holder has a second inner holder inner face concave part disposed on an inner face of a lower end thereof, and the first inner holder outer face protrusion part and the second inner holder inner face concave part are combined with each other.

4. The stick type cosmetic container according to claim 3, wherein a first inner holder intermediate protrusion part is disposed at a central part of the first inner holder, an inner member upper face part is disposed at an upper end of the inner member, and the inner member upper face part is a stopper to be in contact with the first inner holder intermediate protrusion part, and wherein a first inner holder lower face protrusion part is disposed at an outer face of a lower end of the first inner holder in an outer circumferential direction.

5. The stick type cosmetic container according to claim 4, wherein when the first inner holder intermediate protrusion part passes through the inner member upper face part by an external force, the first inner holder outer face protrusion part is released from the second inner holder inner face concave part, so that the first inner holder ascends relative to the second inner holder.

6. The stick type cosmetic container according to claim 1, wherein an inner container upper part disposed at an upper end of the inner container includes an inner container upper face protrusion part, which is a stopper to be in contact with a second inner holder upper end part of the second inner holder.

7. The stick type cosmetic container according to claim 1, wherein an inner holder upper face concave part is disposed at an upper face of the first inner holder.

* * * * *